US010634410B2

(12) United States Patent
Kulkarni et al.

(10) Patent No.: US 10,634,410 B2
(45) **Date of Patent: *Apr. 28, 2020**

(54) APPLICATIONS OF LIQUID TANK AS FRESH FOOD EVAPORATOR

(71) Applicant: Whirlpool Corporation, Benton Harbor, MI (US)

(72) Inventors: Tushar Kulkarni, St. Joseph, MI (US); Lorraine J. Westlake, Eau Claire, MI (US)

(73) Assignee: Whirlpool Corporation, Benton Harbor ( * ) Notice: Subject to any disclaimer, the term of this patent is extended or adjusted under 35 U.S.C. 154(b) by 393 days.

This patent is subject to a terminal disclaimer.

(21) Appl. No.: 15/291,869

(22) Filed: Oct. 12, 2016

(65) Prior Publication Data

US 2017/0038118 A1 Feb. 9, 2017

Related U.S. Application Data

(63) Continuation of application No. 13/828,042, filed on Mar. 14, 2013, now Pat. No. 9,488,403.

(51) Int. Cl.
*F25D 11/00* (2006.01)
*F25D 3/00* (2006.01)
(Continued)

(52) U.S. Cl.
CPC ..... *F25D 11/006* (2013.01); *F25D 3/005* (2013.01); *F25D 11/022* (2013.01);
(Continued)

(58) Field of Classification Search
CPC ..... F25D 11/006; F25D 2303/00; F25D 2303/08; F25D 2303/082; F25D 2303/0822; F25D 2303/083; F25D 2303/0832
See application file for complete search history.

(56) References Cited

U.S. PATENT DOCUMENTS 2,063,646 A 12/1936 Inhitesel
2,188,349 A 1/1940 Heideman
(Continued)

FOREIGN PATENT DOCUMENTS

CN 2709888 Y 7/2005
CN 101963438 B 11/2012
(Continued)

OTHER PUBLICATIONS

Translation of description of DE102012207686. Retrieved on Jun. 2019 (Year: 2019).*

*Primary Examiner* — Kun Kai Ma
(74) *Attorney, Agent, or Firm* — Price Heneveld LLP

(57) ABSTRACT

An appliance having a storage tank disposed on its back surface wherein the storage tank includes a front cover and a back cover that matingly engages the front cover to form a liquid tight seal with the front cover. The storage tank further includes a phase-changing material disposed within the storage tank and a heat exchanger containing refrigerant tubing which transfers cooling from refrigerant tubing to the phase-changing solution. The storage tank, when fully charged with cooling capacity, maintains the food storage compartment at a temperature of 45° F. or less for at least 8 hours without activating a compressor.

16 Claims, 9 Drawing Sheets

(51) Int. Cl.
*F25D 11/02* (2006.01)
*F25D 17/06* (2006.01)

(52) U.S. Cl.
CPC ..... *F25D 17/062* (2013.01); *F25D 2303/00* (2013.01); *F25D 2303/08* (2013.01); *F25D 2303/082* (2013.01); *F25D 2303/083* (2013.01); *F25D 2303/0822* (2013.01); *F25D 2303/0832* (2013.01); *F25D 2600/04* (2013.01); *F25D 2700/12* (2013.01)

(56) References Cited

U.S. PATENT DOCUMENTS 2,271,583 A * 2/1942 Dornhofer ..... B23Q 16/06 29/38 A
2,405,432 A 8/1946 Kleist
2,515,825 A 7/1950 Grant
4,114,396 A 9/1978 Rickert
4,951,481 A 8/1990 Negishi
5,261,247 A * 11/1993 Knezic ..... F25D 11/022 62/117
2002/0129617 A1* 9/2002 Mack ..... F25D 3/005 62/430
2007/0062677 A1* 3/2007 Usui ..... F28D 1/0477 165/150
2009/0151375 A1* 6/2009 Tarr ..... F25D 11/025 62/180

FOREIGN PATENT DOCUMENTS

DE 102012207686 A1 * 11/2013 ..... F25D 11/006
JP 60162738 A 8/1985
KR 2004081288 A 9/2004
WO WO-9405959 A1 * 3/1994 ..... F25D 16/00

* cited by examiner (Section A-A)

APPLICATIONS OF LIQUID TANK AS FRESH FOOD EVAPORATOR

CROSS-REFERENCE TO RELATED APPLICATION

This application is a continuation of and claims priority to pending U.S. patent application Ser. No. 13/828,042, filed Mar. 14, 2013, entitled "APPLICATIONS OF LIQUID TANK AS FRESH FOOD EVAPORATOR," the entire disclosure of which is hereby incorporated herein by reference.

FIELD OF THE INVENTION

The present invention generally relates to an appliance having a food storage tank and the method for constructing therefore.

BRIEF SUMMARY OF THE INVENTION

The present invention provides an appliance with a storage tank which maintains the temperature in the food storage compartment even after power is lost to the appliance. An aspect of the present invention is generally directed toward an appliance comprising an appliance cabinet having a height and a width and having at least one food storage compartment. At least one storage tank is disposed on an interior surface of or within a back wall of the at least one food storage compartment. The storage tank includes a front cover and a back cover that matingly engages the front cover to form a liquid tight seal with the front cover and along with the front cover defines an interior tank volume. The storage tank further includes a phase-changing material disposed within the interior tank volume, and a heat exchanger containing refrigerant tubing which transfers cooling from refrigerant tubing to the phase-changing material. The at least one storage tank has a width that extends at least a majority of the width of the at least one food storage compartment. The storage tank is configured to maintain the food storage compartment at a temperature of 45° F. or less for at least 8 hours without activating a compressor when the storage tank fully charged with cooling capacity.

Another aspect of the present invention is generally directed toward an appliance comprising an appliance cabinet having a height and a width and having at least one food storage compartment. At least one storage tank is disposed on an interior surface of or within a back wall of the at least one food storage compartment. The storage tank includes a front cover and a back cover that matingly engages the front cover to form a liquid tight seal with the front cover and along with the front cover defines an interior tank volume. The storage tank further includes a phase-changing material disposed within the interior tank volume, and a heat exchanger containing refrigerant tubing which transfers cooling from refrigerant tubing to the phase-changing material. The at least one storage tank has a height that extends at least a majority of the height of the at least one food storage compartment. The storage tank is configured to maintain the food storage compartment at a temperature of 45° F. or less for at least 8 hours without activating a compressor when the storage tank fully charged with cooling capacity.

Yet another aspect of the present invention is generally directed towards a method of maintaining a food storage compartment at a temperature of about 45° F. for at least 8 hours comprising the step of chilling a phase-changing material disposed within a storage tank. The storage tank comprises a front cover and a back cover that matingly engages the front cover to form a liquid tight seal with the front cover and along with the front cover defines an interior tank volume. Additionally, the storage tank comprises a phase-changing material disposed within the interior tank volume and a heat exchanger containing refrigerant tubing which transfers cooling from refrigerant tubing to the phase-changing solution. The at least one storage tank has a height that extends at least a majority of a height of the food storage compartment. The storage tank is disposed on an interior surface of or within a back wall of the food storage compartment.

DETAILED DESCRIPTION OF THE PREFERRED EMBODIMENTS

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

Figure 1:
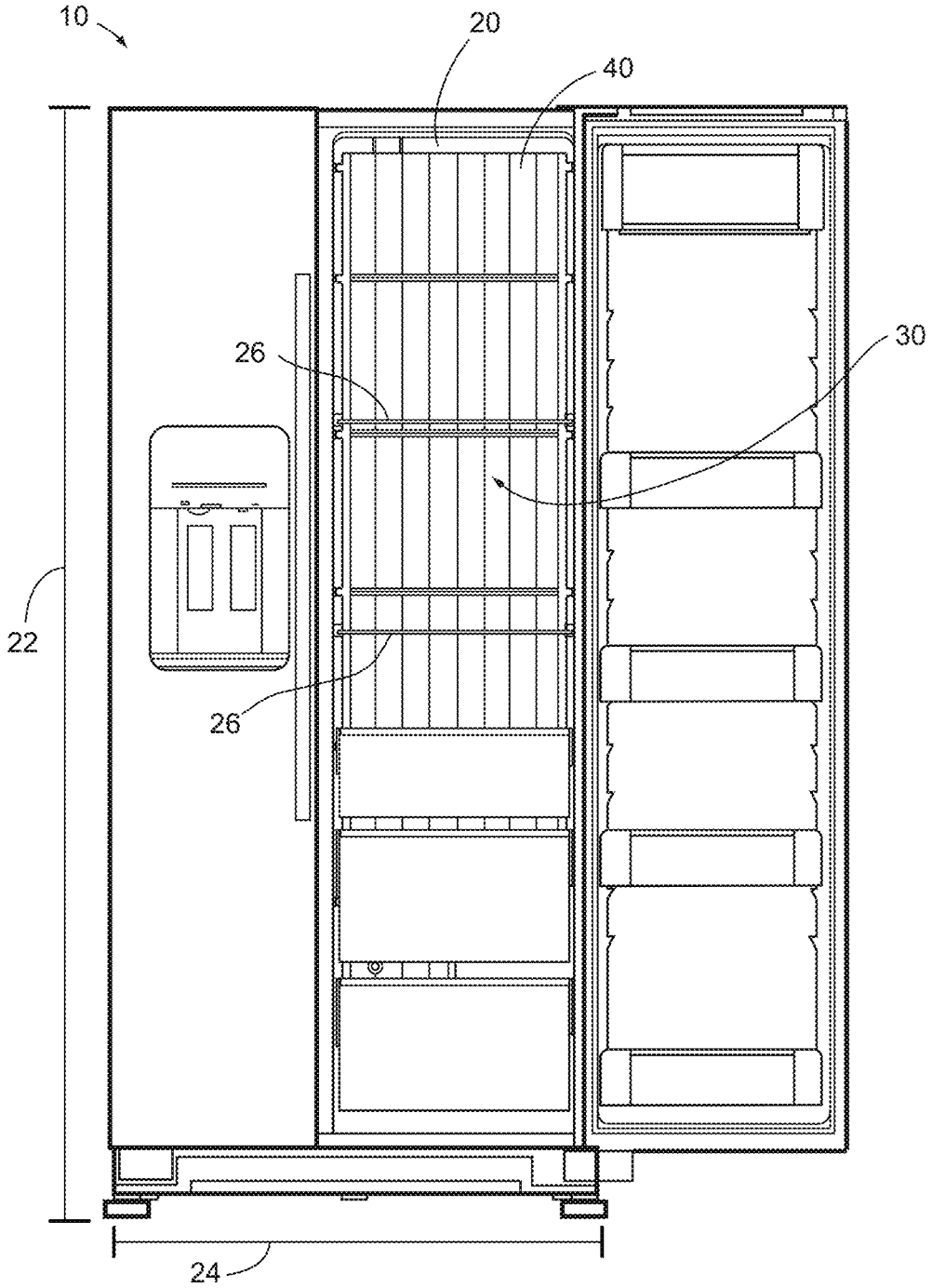
FIG. 1 is a front elevational view of one embodiment of the present invention.

As shown in FIG. 1, reference number 10 generally designates an appliance 10. The appliance 10 is generally comprised of an appliance cabinet 20 having a height 22 and a width 24 and having at least one food storage compartment 30. The food storage compartment 30 has at least one storage tank 40 located on an interior surface 34 (See FIG. 6) of the food storage compartment 30 or within a back wall 32 (see FIG. 8) of the food storage compartment 30. The storage tank 40 has a width 46 (see FIG. 7), which typically extends at least a majority of the width 38 (see FIG. 6) of the at least one food storage compartment 30. Additionally, the height 48 (see FIG. 7) of the storage tank 40 typically extends at least a majority of the height 36 (see FIG. 6) of the food storage compartment 30. Moreover, the storage tank 40 is configured to maintain the food storage compartment 30 at a temperature of 45° F. or less for at least (about) 8 hours without activating a compressor during normal operation after receiving its full chilling load. The present invention can be used to improve energy efficiency of sequential dual evaporator refrigeration systems or any other typical refrigeration system. Additionally, the storage tank 40 can be configured to maintain a temperature desired by a user, typically from about 35° F. to about 45° F.

Figure 2:
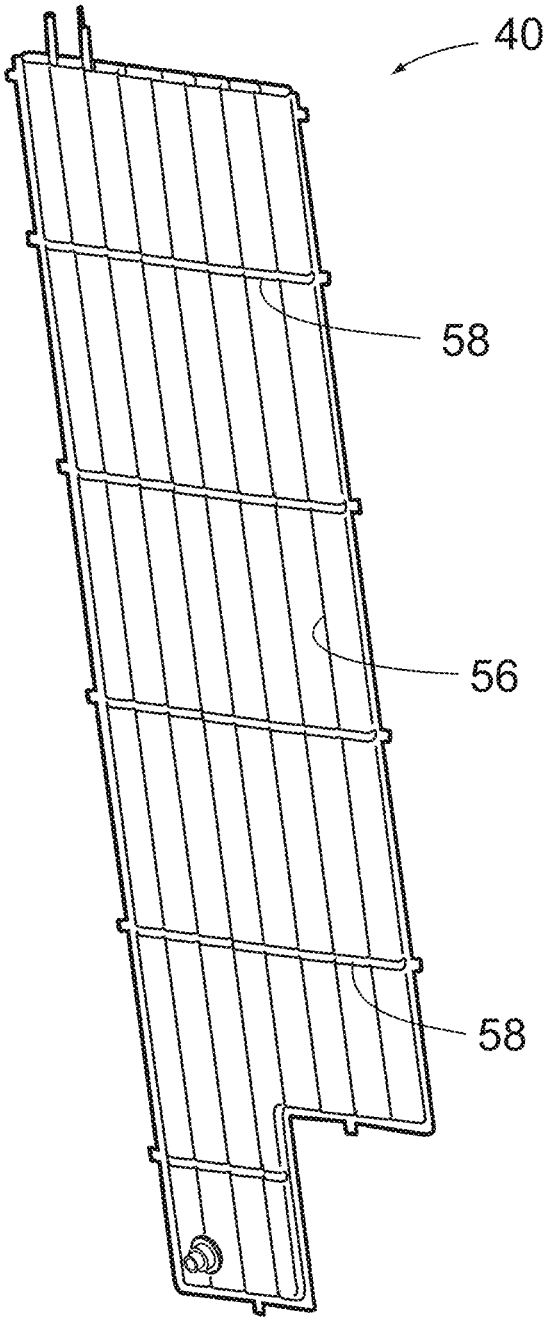
FIG. 2 is a perspective view of the storage tank of the present invention.
Figures 3, 4, 5:
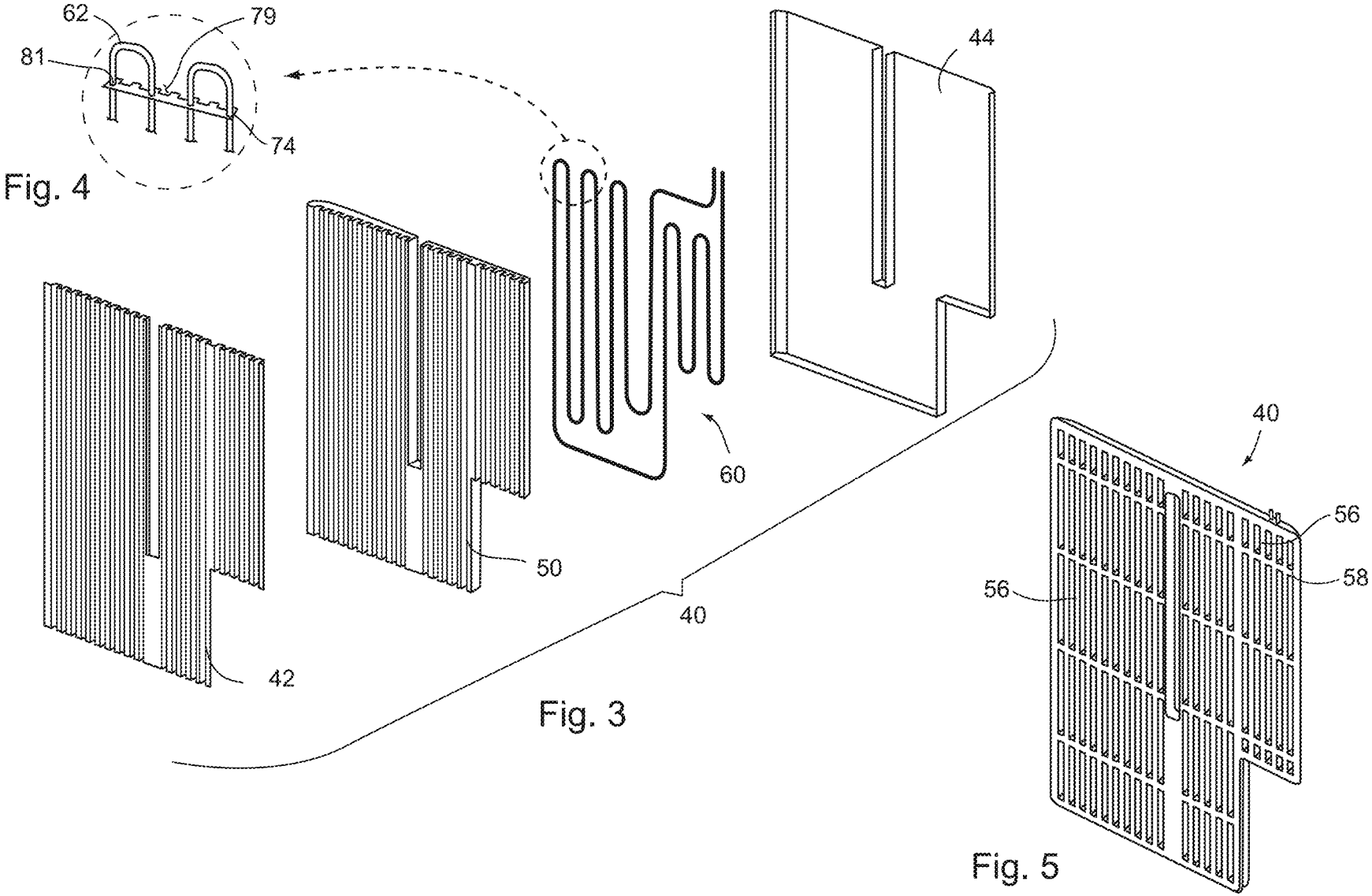
FIG. 3 is an exploded perspective view of one embodiment of the storage tank of the present invention.
FIG. 4 is an enlarged perspective view of the circled section of FIG. 3.
FIG. 5 is a perspective view of another embodiment of the storage tank of the present invention.

FIGS. 2 and 3 show the storage tank 40 removed from the appliance 10. The storage tank 40 generally comprises a front cover 42 and a back cover 44 which matingly engages the front cover 42 to form a liquid tight seal with the front cover 42 and along with the front cover 42 defines an interior tank volume. A phase-changing material 50 is disposed within the interior tank volume. Also included in the storage tank 40 is a heat exchanger 60 which contains refrigerant tubing 62 that transfers the cooling from the refrigerant tubing 62 to the phase-changing solution 50. The heat exchanger 60 may also include fins 74 to aid in heat transfer. As shown in FIG. 2, the storage tank 40 typically includes a plurality of vertical grooves 56 in order to increase the heat transfer area of the storage tank 40 and a plurality of horizontal grooves 58 to provide structural strength to the storage tank 40. The vertical grooves 56 form a plurality of vertically disposed channels that form elongated phase-changing material 50 retention cavities. The vertical grooves 56 may be arranged on the front cover 42 of the storage tank 40 such that the grooves 56 provide more or less surface area exposure in strategic places inside the food storage compartment 30. For example, if additional cooling capacity is desired in an upper part of the food storage compartment 30, an upper portion of the storage tank 40 would include additional grooves 56 to provide the additional cooling capacity. FIG. 3 shows how the storage tank 40 fits together with the front cover 42 and the back cover 44 providing a liquid tight seal for the phase-changing material 50 and the refrigerant tubing 62. The phase-changing material 50 may be any material with a desired freezing temperature lower than water, and is typically a glycol water solution. Additionally, the phase-changing material 50 can be replaced by thermal storage media which may or may not freeze during normal operation of the appliance 10.

As shown in FIG. 4, the refrigerant tubing 62 includes a plurality of fins 74 in order to increase the surface area of the heat exchanger 60. The fin 74 may contain alternating rectangularly shaped cutouts 79 and rectangularly shaped refrigerated tubing receiving protrusions 81. The cutouts 79 help maximize heat exchanger 60 exposure to solution 50 by fitting into spaces of the vertical grooves 56. The protrusions 81 alternately, operably, and matingly engage the refrigerant tubing 62 and are configured to be in a thermal exchange relationship with the refrigerant tubing 62. Moreover, the plurality of fins 74 extend between the front cover 42 and the back cover 44. Additionally, the fins 74 may run horizontal to a length of the refrigerant tubing 62 (not shown). Moreover, the fins 74 may run parallel to the length of the refrigerant tubing 62 and occupy the space between the tubing 62 and generally centrally located with respect to the front cover 42 and then back cover 44 of the storage tank 40. Alternatively, the fins 74 could be in any other configuration that increases the surface area between the refrigerant tubing 62 and the phase-changing material 50.

FIG. 5 shows another embodiment of the storage tank 40 of the present invention. The storage tank 40 may be of any size or shape and is typically configured to extend (at least) the majority of the height 36 and/or width 38 of the food storage compartment 30 (see FIG. 6).

The storage tank 40 can be disposed on an interior surface 34 or within the back wall 32 of an appliance of one configuration including a side by side configuration (see FIGS. 1-2), a top mount freezer configuration, a BMFC or a French door bottom mount freezer configuration appliance (see FIGS. 3-7).

Figure 7:
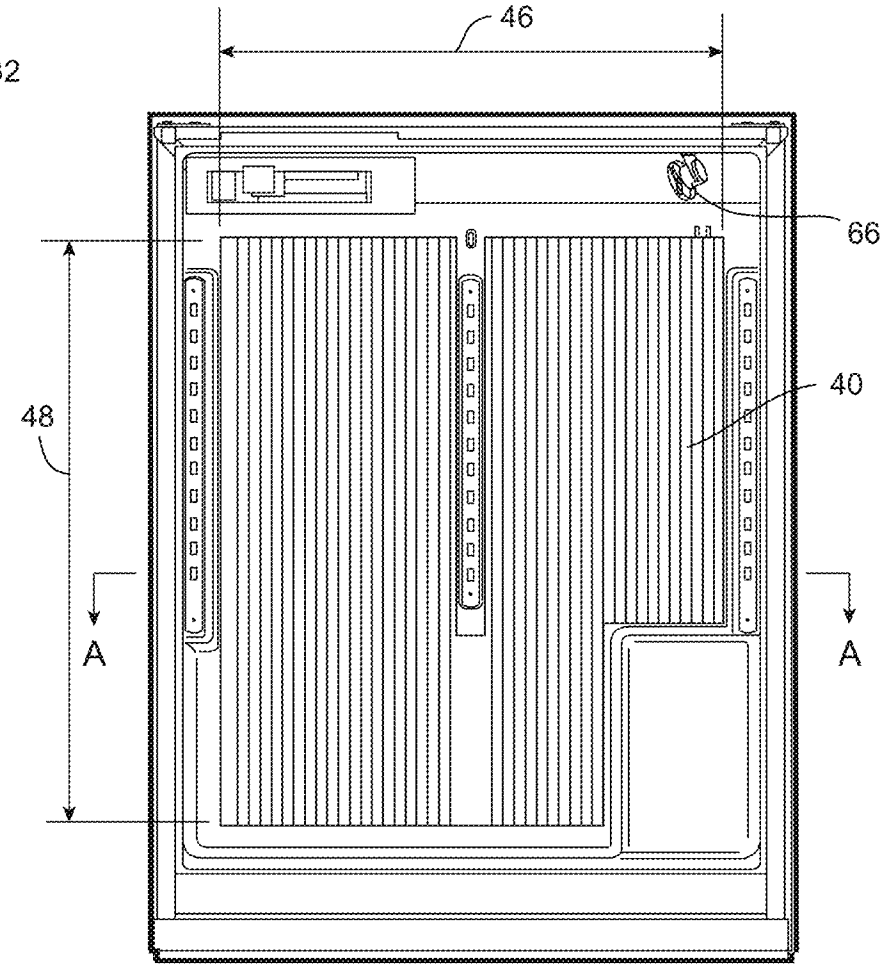
FIG. 7 is a front elevational view of the appliance cabinet of the present invention.
Figure 6:
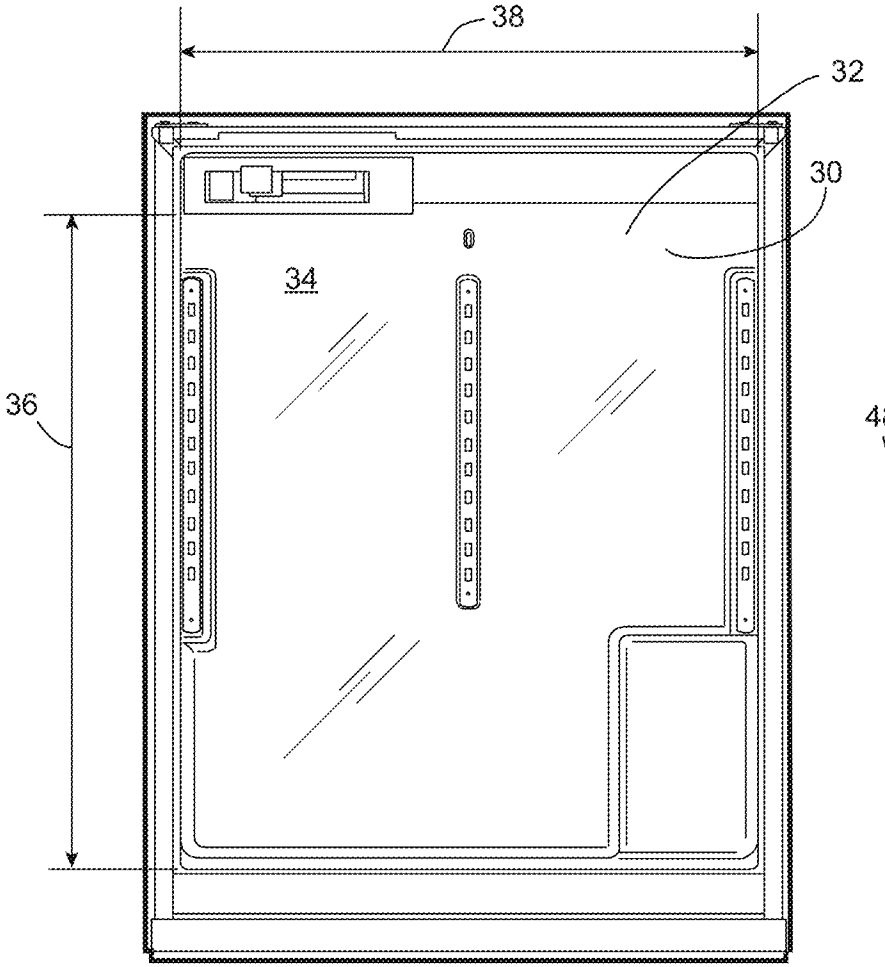
FIG. 6 is a front elevational view of the appliance cabinet of the present invention prior to installation of the storage tank.

FIG. 6 shows the appliance 10 having its doors removed showing the inside of the food storage compartment 30. The food storage compartment 30 has a height 36 and a width 38. FIG. 7 shows the storage tank 40 disposed on an interior surface 34 of the food storage compartment 30. The storage tank 40 has a width 46 which is at least a majority of the width 38 of the food storage compartment 30 and a height 48 which extends at least the majority the height 36 of the food storage compartment 30.

Figure 8:
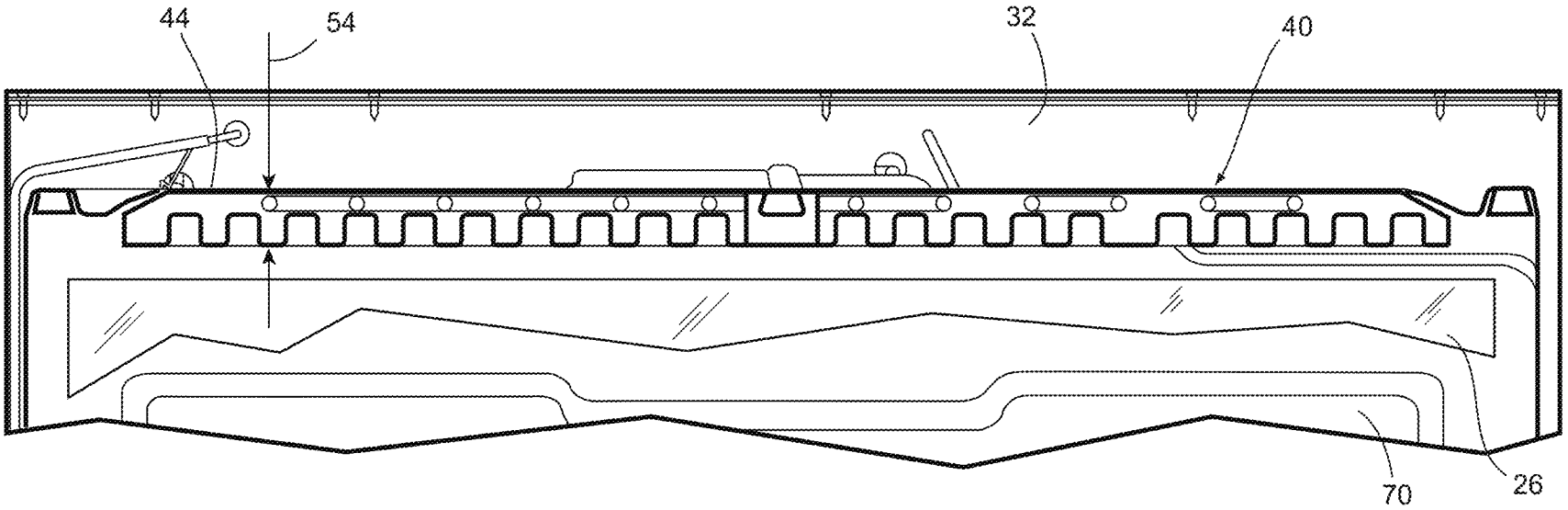
FIG. 8 is a cross-sectional view of FIG. 7 at cross section A-A.

FIG. 8 is cross section A-A of FIG. 7 and shows the back wall 32 of the food storage compartment 30. FIG. 8 also shows the thickness 54 of the storage tank 40 and the configuration of the appliance shelves 26 in the appliance 10. Typically, the at least one storage tank 40 has a height 48 to thickness 54 ratio from 25:1-32:1, and preferably about 28:1 and a width 46 to thickness 54 ratio from 20:1-28:1 and preferably about 24:1. This ensures the storage tank 40 fits behind the appliance shelves 26 (see FIG. 1) and maximizes customer storage capacity. The back cover 44 of the storage tank 40 has a planar back surface that is typically in abutting contact with the back wall 32 of the food storage compartment 30. It is contemplated that the back cover 44 of the storage tank 40 is separated from the back wall 32 of the food storage compartment 30 and defines an air-flow channel.

Figure 10:
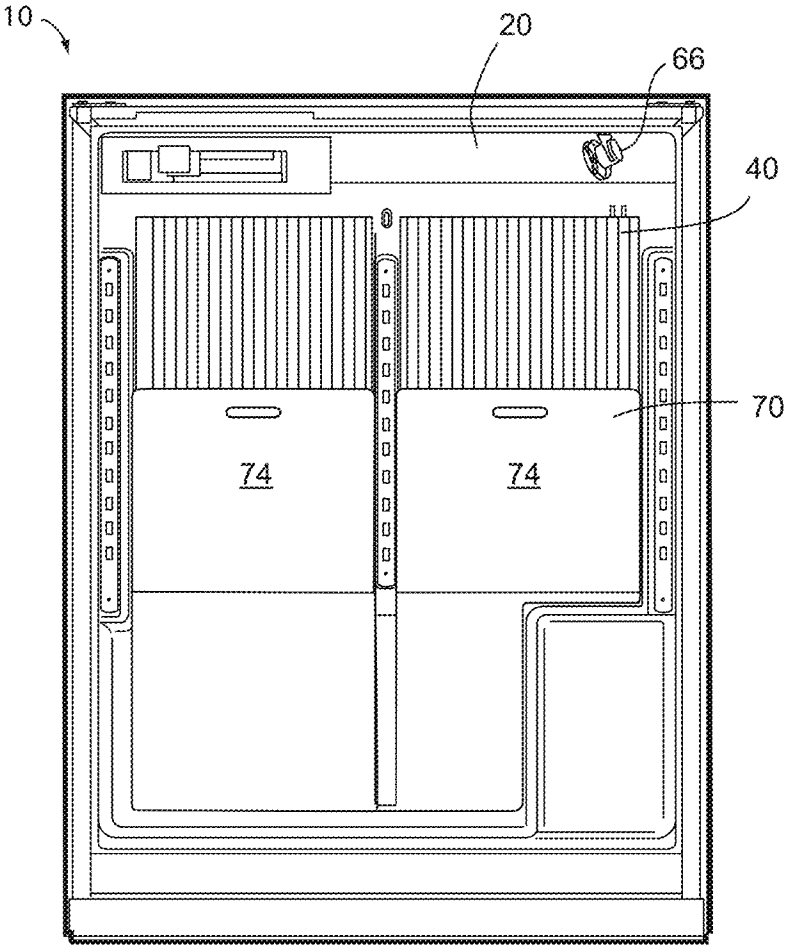
FIG. 10 is a front elevational view of the appliance cabinet of the present invention.
Figure 9:
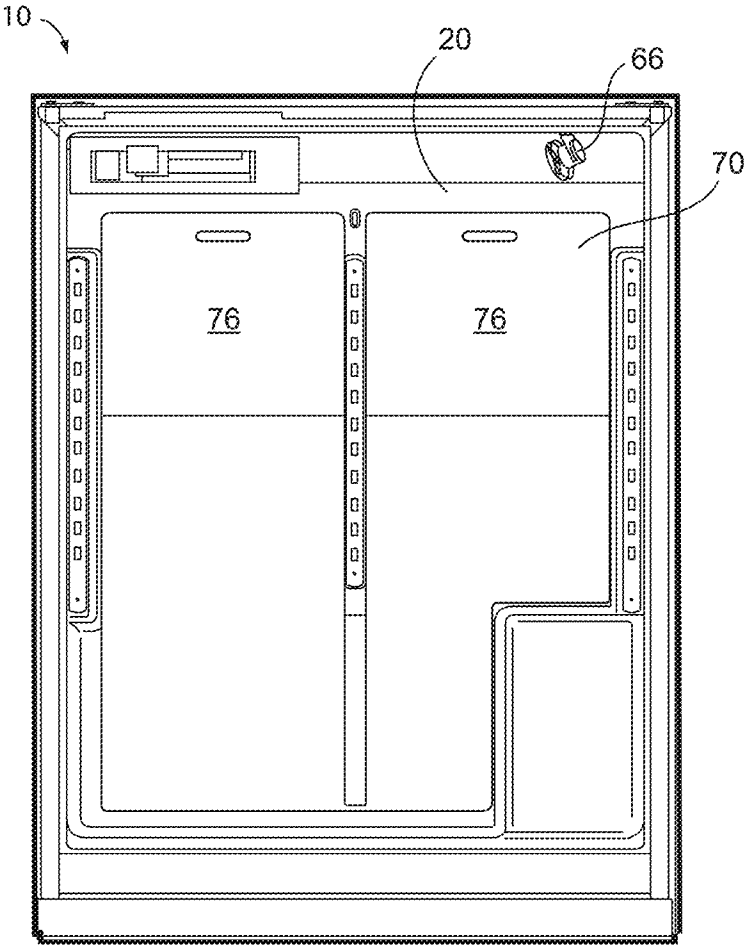
FIG. 9 is a front elevational view of one embodiment of the appliance cabinet of the present invention.

FIGS. 9 and 10 show an embodiment of the present invention in which the appliance 10 includes a liner 70 disposed in an interior of the appliance cabinet 20. The liner 70 comprises a tank exposing mechanism (not shown) typically along the back wall 32 of the food storage compartment 30. The tank exposing mechanism is configured to move the liner 70 between an open storage tank exposing position 74, shown in FIG. 10, and a closed position 76 where air within the cabinet 20 is not directly exposed to the storage tank 40, as shown in FIG. 9. In the open position 74 the liner 70 is configured to directly expose the air within the cabinet 20 to the storage tank 40 in order to provide superior cooling. The liner 70 is configured to be moved manually by a user or by any mechanical means. In one embodiment, the liner 70 is configured to be automatically positioned in the open position 74 when the food storage compartment 30 is at a temperature of greater than 45° F. (or about 45° F.). In another embodiment, or in combination with any of the above previous embodiments, the tank exposing mechanism 72 is configured to automatically expose the storage tank 40 directly to the air within the appliance cabinet 20 when the appliance 10 loses power and the food storage compartment 30 reaches a temperature of greater than 45° F. (or about 45° F.). Additionally, the appliance 10 may include at least one stir fan 66 operably coupled to the food storage compartment 30. The stir fan 66 is typically positioned to move air across a substantial portion of the at least one storage tank 40 and into the food storage compartment 30.

Figure 12:
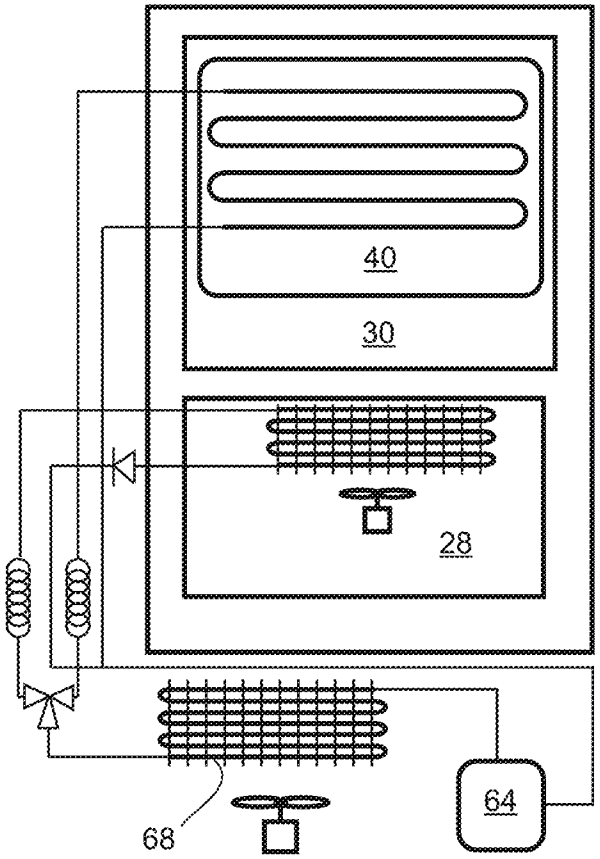
FIG. 12 is a schematic view of one embodiment of the present invention.
Figure 14:
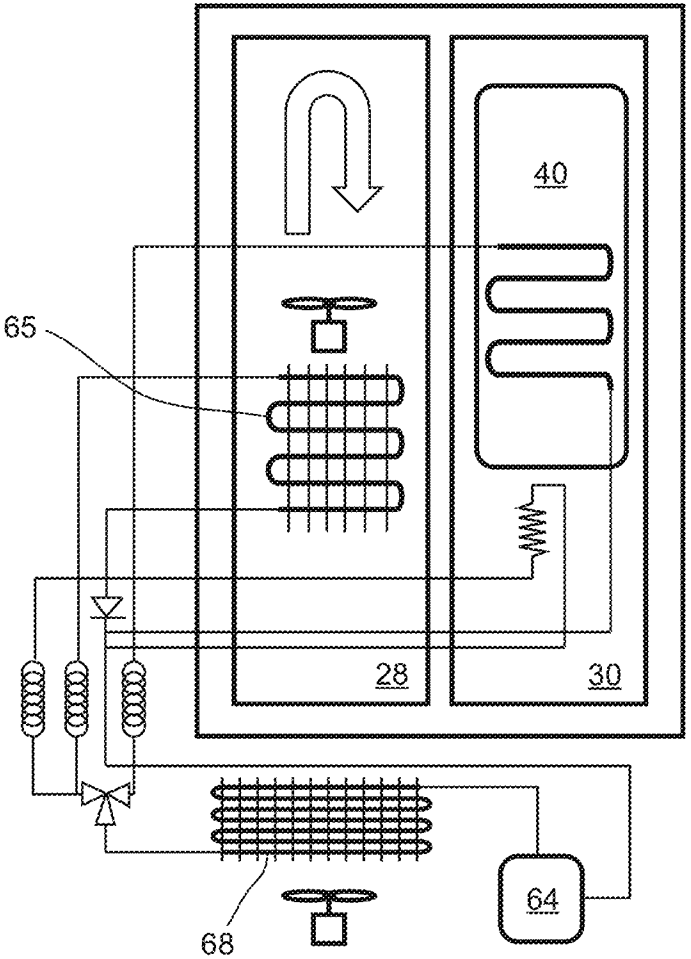
FIG. 14 is a schematic view of yet another embodiment of the present invention.
Figure 13:
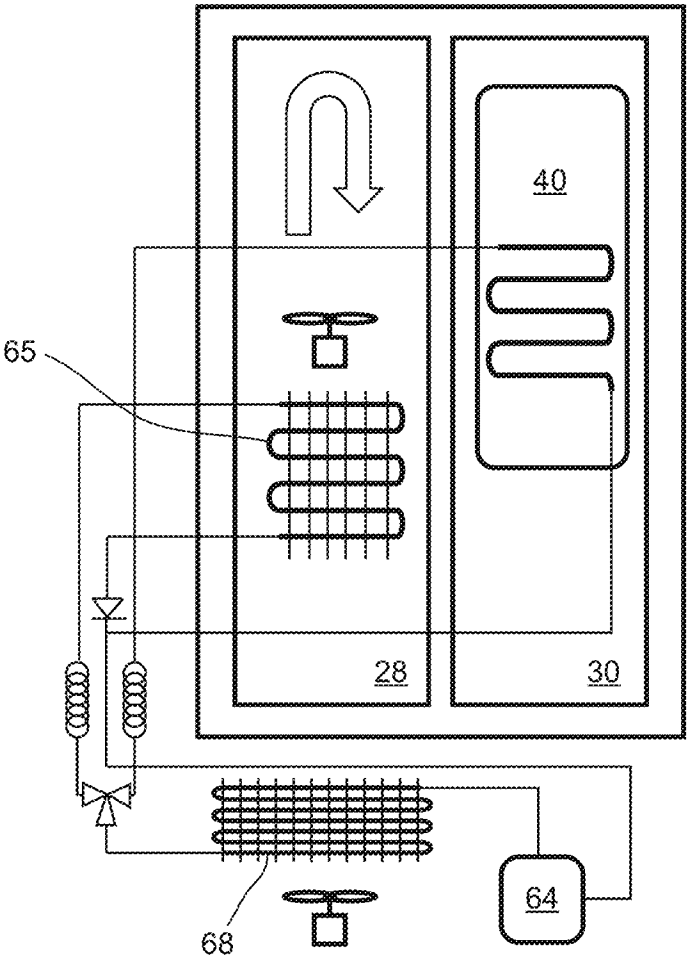
FIG. 13 is a schematic view of another embodiment of the present invention.

FIGS. 12-14 show schematic views of the appliance 10. FIG. 12 shows the appliance 10 as a top and bottom mount refrigerator while FIG. 13 shows the appliance 10 in a side-by-side configuration. The storage tank 40 is configured to be disposed on an interior surface 34 of either a top and bottom or a side by side mount refrigerator. The storage tank 40 may be the only cooling apparatus positioned to provide cooling to the food storage compartment 30 (FIG. 13), or the food storage compartment 30 may include an additional evaporator 65 (FIG. 14). As shown in FIGS. 12-14, the apparatus 10 may further include at least one compressor 64, at least one evaporator 65, and at least one condenser 68.

Figure 11:
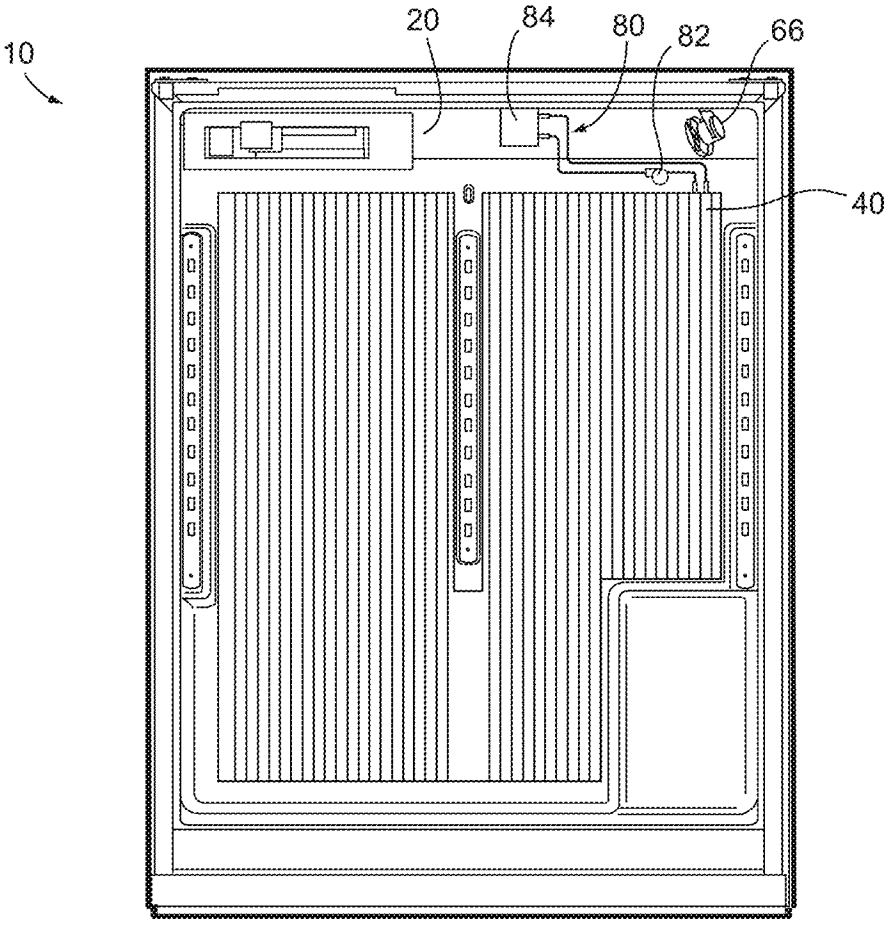
FIG. 11 is a front elevational view of yet another embodiment of the present invention.
Figure 15:
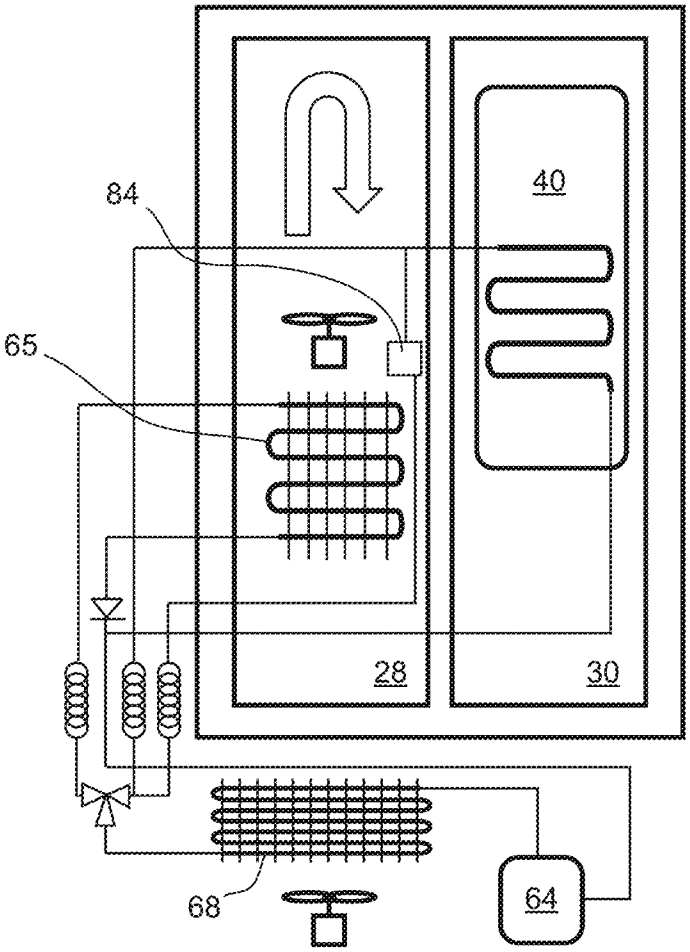
FIG. 15 is a schematic view of still another embodiment of the present invention.

In yet another embodiment, or in combination with any of the above previous embodiments, as shown in FIGS. 11 and 15, the appliance 10 may further include a secondary cooling loop 80. In the secondary cooling loop 80, cooling provided by the storage tank 40 is pumped to provide superior cooling for at least one specialty cooling feature 84. The secondary cooling loop 80 is a compressorless and condensorless loop and further comprises a refrigerant pump 82. The at least one specialty cooling feature 84 is chosen from a variety of features, including a 0 degree compartment, a turbo chill compartment, an ice storage compartment, and an ice making compartment and may be disposed in either the fresh food compartment 30 or a freezer compartment.

Those skilled in the art with recognize, or be able to ascertain using no more than routine experimentation, many equivalents to the specific embodiments of the invention described herein. Such equivalents are intended to be encompassed by the following claims.

What is claimed is:

1. An appliance comprising:

an appliance cabinet having at least one food storage compartment and at least one storage tank proximate a back wall of the at least one food storage compartment, the at least one storage tank comprising:

a front cover and a back cover defining an interior tank volume;

a phase-changing material disposed within the interior tank volume; and a heat exchanger which draws heat from the phase-changing material; and a liner disposed about an interior of the appliance cabinet, wherein the liner comprises a tank exposing mechanism along the back wall of the at least one food storage compartment that is configured to move between an open storage tank exposing position where the at least one storage tank is directly exposed to air within the food storage compartment and a closed position where air within the food storage compartment is not directly exposed to the at least one storage tank, and further wherein the tank exposing mechanism is configured to automatically move to the open storage tank exposing position when the appliance loses power.

2. The appliance of claim 1, wherein the phase-changing material is a solution and wherein a height of the at least one storage tank extends at least a majority of a height of the at least one food storage compartment.

3. The appliance of claim 1, wherein the tank exposing mechanism is configured to automatically open when a temperature of the at least one food storage compartment is measured by a temperature sensor within the at least one food storage compartment.

4. The appliance of claim 1, wherein the appliance is configured to open the tank exposing mechanism when the appliance loses power and the at least one food storage compartment is at a temperature of greater than 45° F. to automatically expose the at least one storage tank directly to the air within the appliance cabinet.

5. The appliance of claim 1, further comprising:

at least one stir fan, operably coupled to the at least one food storage compartment and positioned to move air across a substantial portion of the at least one storage tank and into the at least one food storage compartment.

6. The appliance of claim 1, further comprising:

at least one fin configured to maximize surface area exposure of the heat exchanger and disposed between the front cover and the back cover, the at least one fin having rectangularly shaped cut-outs and rectangularly shaped refrigerated tubing receiving upright sections, wherein the rectangularly shaped refrigerated tubing receiving upright sections alternately, operably, and matingly engage refrigerated tubing of the heat exchanger and are configured to be in a thermal exchange relationship and extending between the front cover and the back cover.

7. The appliance of claim 1, further comprising:

a secondary cooling loop configured to supply cooling used for at least one specialty cooling feature wherein the secondary cooling loop is a compressorless and condensorless loop that further comprises a refrigerant pump.

8. The appliance of claim 7, wherein the at least one specialty cooling feature is chosen from a group consisting of a 0° compartment, a turbo chill compartment, an ice storage compartment, and an ice making compartment.

9. The appliance of claim 1, wherein the at least one storage tank has a thickness and the at least one storage tank has a height to thickness ratio of from about 32:1 to about 28:1.

10. The appliance of claim 1, wherein the front cover comprises a plurality of vertically disposed channels that form elongated phase-changing material retention cavities to increase surface area of the at least one storage tank exposed to air in the at least one food storage compartment.

11. The appliance of claim 1, wherein the back cover of the at least one storage tank includes a planar back surface in abutting contact with the back wall of the appliance cabinet.

12. The appliance of claim 1, wherein the front cover of the at least one storage tank comprises grooves extending an entire width of the at least one storage tank.

13. An appliance comprising:

an appliance cabinet having a food storage compartment and a storage tank on an interior surface thereof, the storage tank comprising:

an interior tank;

a phase-changing material disposed within the interior tank; and a heat exchanger which draws heat from the phase-changing material; and a liner disposed about an interior of the appliance cabinet, wherein the liner comprises a tank exposing mechanism along a back wall of the at least one food storage compartment that is configured to move between an open storage tank exposing position where the storage tank is directly exposed to air within the food storage compartment and a closed position where air within the food storage compartment is not directly exposed to the storage tank, and further wherein the appliance is configured to open the tank exposing mechanism when the appliance loses power and the at least one food storage compartment is at a temperature of greater than 45° F. to automatically expose the storage tank directly to the air within the appliance cabinet.

14. The appliance of claim 13, wherein the storage tank has a thickness and the storage tank has a height to thickness ratio of about from 32:1 to 25:1.

15. The appliance of claim 13, wherein the storage tank has a thickness and the storage tank has a width to thickness ratio of about from 20:1 to 28:1.

16. A method of maintaining a food storage compartment at a temperature of about 45° F. for at least eight hours comprising steps of:

defining an interior tank volume of a storage tank;

filling the interior tank volume with a phase-changing material;

chilling the phase-changing material disposed within the interior tank volume of the storage tank;

providing a heat exchanger which transfers heat from the phase-changing material;

constructing the storage tank to have one of a height and a width that extends at least a majority of one of a height and a width, respectively, of the food storage compartment;

positioning the storage tank on one of an interior surface of the food storage compartment and proximate a back wall of the food storage compartment; and exposing the storage tank to air within the food storage compartment when said food storage compartment loses power and said food storage compartment is at a temperature greater than 45° F.

* * * * *